United States Patent [19]

Nicholas

[11] 4,378,177

[45] Mar. 29, 1983

[54] GUTTERING

[75] Inventor: Terry G. Nicholas, Twyford, England

[73] Assignee: Wavin B.V., Zwolle, Netherlands

[21] Appl. No.: 274,626

[22] Filed: Jun. 17, 1981

[30] Foreign Application Priority Data

Jun. 20, 1980 [GB] United Kingdom ..... 8020209
Jul. 1, 1980 [GB] United Kingdom ..... 8021440

[51] Int. Cl.[3] ..... E02B 9/04; E04D 13/06
[52] U.S. Cl. ..... 405/121; 52/11
[58] Field of Search ..... 405/119, 120, 121, 122, 405/123; 52/11, 16; 248/48.1, 48.2

[56] References Cited

U.S. PATENT DOCUMENTS 3,355,895 12/1967 Bayes et al. ..... 52/11 X
3,611,731 10/1971 Edmondson ..... 405/120
3,841,101 10/1974 Henfrey ..... 405/122
4,327,051 4/1982 Edmondson ..... 405/121 X

FOREIGN PATENT DOCUMENTS 2002739 8/1971 Fed. Rep. of Germany ..... 405/121
1709399 8/1973 Fed. Rep. of Germany ..... 405/121

*Primary Examiner*—David H. Corbin
*Attorney, Agent, or Firm*—Wil kinson, Mawhinney & Theibault

[57] ABSTRACT

A gutter fitting 1 comprises a body member 2 defining a channel for receiving therein a gutter length. A sealing member 6 extends through a slot 8 in the body member and has a respective compressible sealing portion 9 extending transversely of the slot 8 on one or each side of the slot for providing a seal between the inside surface 10 of the body member and the outside surface of a gutter length (not shown) received in the channel. The sealing arrangement is particularly applicable to rectilinear gutter systems.

9 Claims, 3 Drawing Figures

GUTTERING

This invention relates to guttering and more particularly to gutter fittings.

Known gutter fittings, such as gutter support brackets, unions and downpipe connectors include a channel for receiving a gutter length therein and a sealing member protruding inwardly of the channel for providing a seal against a gutter length when received in the channel.

An object of this invention is to provide a gutter fitting in which the sealing arrangement is able to cater for manufacturing tolerances in guttering of so-called 'rectilinear' cross-section in which the cross-section has a shape formed by a number of straight lines. However, it is to be understood that in addition to gutter fittings for guttering of rectilinear cross-section, the invention is applicable to gutter fittings for guttering of curved cross-section, for example part circular.

The invention includes a gutter fitting comprising a body member defining a channel for receiving therein a gutter length and a sealing member protruding inwardly of the channel for providing a seal against a gutter length when received in the channel, said sealing member having locating portion means comprising a single locating portion or a plurality of locating portions extending through slot means in the body extending transversely of the channel and comprising a single slot or a row of openings to locate the sealing member, and a respective compressible sealing portion extending transversely of the slot inwardly of the body member on one or each side of the slot for providing a seal between the inside surface of the body member and the outside surface of a gutter length when the latter is received in the channel.

In order that the invention may be well understood, an embodiment thereof, which is given by way of example only, will now be described, reference being had to the accompanying drawings, in which.

Figure 1:
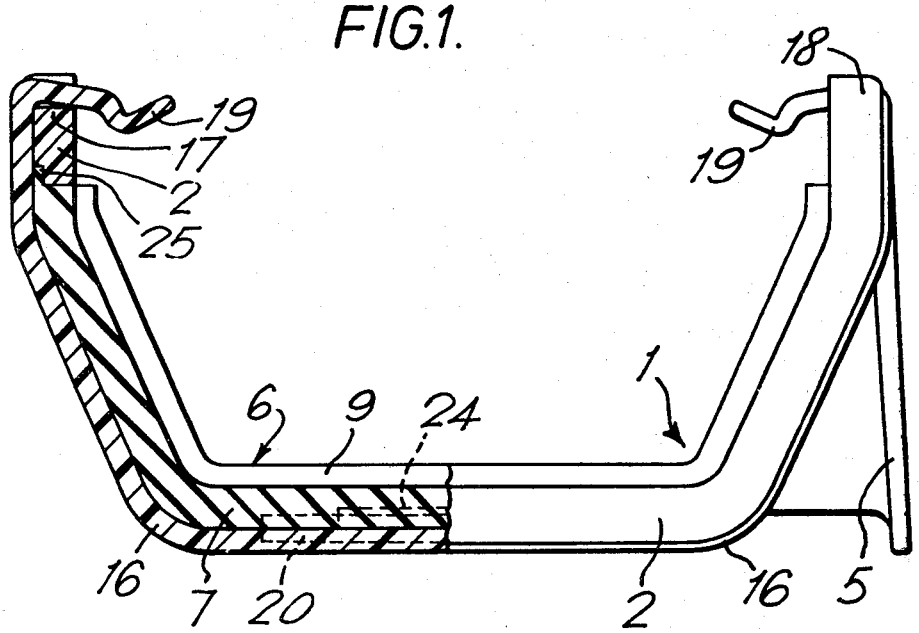
FIG. 1 is a part sectional side elevation of a gutter fitting, the section being taken along the line X—X in FIG. 2.
Figure 2:
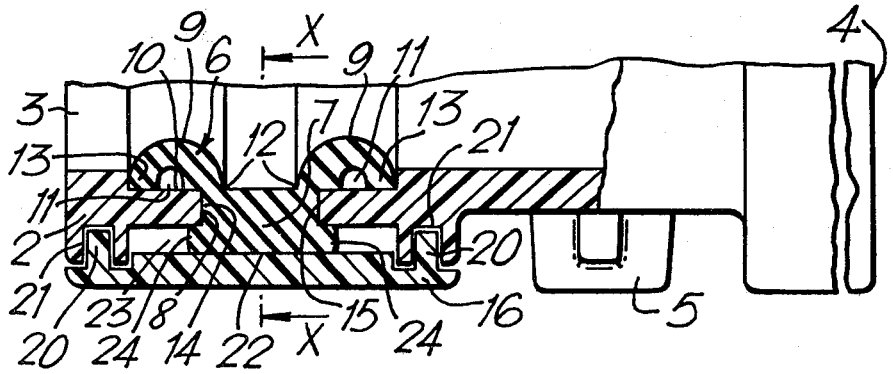
FIG. 2 is a part sectional front view of the same fitting.

Referring to the drawings there is shown a gutter fitting 1 forming a combined union and support bracket for guttering of rectilinear cross-section. The fitting has a plastics injection moulded body member 2 which defines a channel having rectilinear sides. Opposite ends 3, 4 of the channel receive the end portions of respective gutter lengths (not shown). The body member has a bracket 5 integrally moulded therewith to enable the fitting to be secured to a facia board (not shown) of a building.

A respective sealing member is provided at each end 3, 4 of the channel protruding inwardly thereof for sealing against a gutter length received in the channel.

The sealing member 6 at end 3 is illustrated in the drawings and has a locating portion 7 extending through slot means shown here as a single slot 8 in the body member, which slot extends transversely of the channel, to locate the sealing member in the body member and a respective compressible sealing portion 9 extending transversely of the slot 8 inwardly of the body member on each side of the slot for providing a seal between the inside surface 10 of the body member and the outside surface of a gutter length (not shown) when the latter is received in the channel. Each sealing portion 9 defines a recess 11 opening towards the inside surface 10 of the body member to allow appreciable compression of the sealing portion, thus ensuring a reliable sealing between the gutter length and the body member to allow for non-alignment of the corresponding sides and angles of the gutter length and body member due to manufacturing tolerances. As illustrated, each sealing portion 9 is substantially U-shaped in cross-section, one end 12 being connected to the locating portion 7 and the other free end 13 terminating adjacent the inside surface of the body member. Whilst it is preferred to have two sealing portions 9, one on each side of the slot, it is to be understood that a single sealing portion on one side of the slot may be provided instead.

The sealing member in addition to providing seals between the gutter length and the inside of the body member through sealing portions 9, seals against the opposed surfaces 14, 15 of the slot 8 through the locating portion's configuration, which in the illustrated fitting tapers inwardly away from the sealing portions 9 so as to be in wedging engagement with the opposed surfaces of the slot.

A retaining member comprising a plastics injection moulded clip 16 extends over the outside of the body member. The clip is snap-fittable to and extends between opposite longitudinal edges 17, 18 of the body member 2 and has end portions 19 which overlie the longitudinal edges 17, 18 for clamping a gutter length in the channel in sealing engagement with each sealing portion 9 such that the sealing portions are compressed between the inside surface 10 of the body member and the outside surface of the gutter length.

It will be appreciated that the clamping action of the clip 16 also acts on the tapered locating portion 7 to assist its sealing engagement with the opposed surfaces of the slot. Due to engagement of the opposed surfaces of the slot by the tapered locating portion there is a tendency for the slot to widen. Such widening is limited by the provision of inwardly projecting portions 20 which engage recesses 21 in the body member on each respective side of the slot over at least a central portion of the length of the slot, as illustrated.

The end 22 of the locating portion 7 remote from the sealing portions 9 is received within a passage 23 defined between the clip 16 and the body member 2 and engages the retaining member. This engagement is such that the locating portion is slightly compressed and serves both to hold the clip in position on the body member prior to installation and to prevent rattling between the surfaces of the clip and body member.

The locating portion 7 extends transversely of the slot 8 in the passage 23 over at least the central portion of the slot through tabs 24 extending transversely of the locating portion. These tabs and further tabs 25 provided at each end of the sealing member assist retention of the sealing member in the fitting against displacement for example during fitting of guttering in the fitting, and to this end they may be of such a depth as to be clamped in the passage 23. The tabs 24, 25 also serve to locate the sealing member in the body member during assembly of the fitting prior to the fitting of the clip to the body member.

Figure 3:
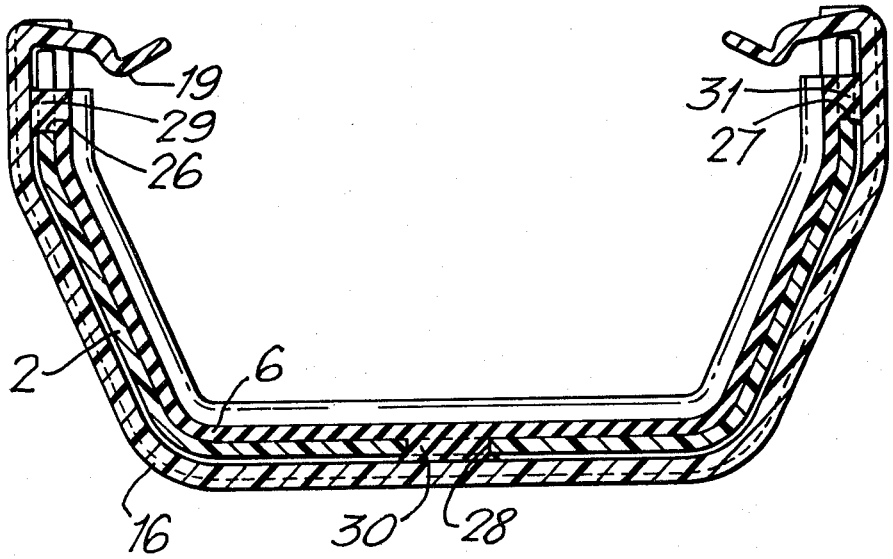
FIG. 3 is a part sectional side elevation similar to FIG. 3 of a modified gutter fitting.

In a modified embodiment shown in FIG. 3, the single slot 8 in the body member is replaced by slot means which comprise a row of openings 26, 27 and 28 in the body member 2 extending transversely of the channel through which openings respective discrete locating portions 29, 30 and 31 extend to locate the sealing member 6. These locating portions seal against the insides of the openings and may be tapered in a similar fashion to the locating portion 7 so as to be in wedging engagement with the openings. The openings and corresponding locating portions may be substantially rectangular or circular cross-section. At present we prefer an arrangement as illustrated in which the row comprises openings 26, 27 opening at the longitudinal edges of the body member and an opening 28 central of the body member 2.

I claim:

1. A gutter fitting comprising a body member defining a channel for receiving therein a gutter length and a sealing member protruding inwardly of the channel for providing a seal against a gutter length when received in the channel, said sealing member having locating portion means extending through slot means in the body member, which slot means extend transversely of the channel, to locate the sealing member, and compressible sealing portion means extending transversely of the slot means inwardly of the body member on at least one side of the slot means for providing a seal between the inside surface of the body member and the outside surface of a gutter length when the latter is received in the channel.

2. A gutter fitting as claimed in claim 1, wherein the sealing portion means defines a recess opening towards the inside surface of the body member.

3. A gutter fitting as claimed in claim 2, wherein the sealing portion means is substantially U-shaped in cross-section, one end being connected to the locating portion means and the other end terminating adjacent the inside surface of the body member.

4. A gutter fitting as claimed in claim 1, wherein the locating portion means is configured to seal against the inside of the slot means.

5. A gutter fitting as claimed in claim 4, wherein the locating portion means tapers away from the sealing portion means and is in wedging engagement with the slot means.

6. A gutter fitting as claimed in claim 1, wherein the slot means comprise a slot, and further comprising a retaining member extending over the outside of the body member and having inwardly projecting portions which engage the body member on each respective side of the slot over at least a central portion of its length to limit any tendency for the slot to widen in use.

7. A gutter fitting as claimed in claim 1, further comprising a retaining member which comprises a clip snap-fittable to and extending between opposite longitudinal edges of said body member, the clip having end portions which overlie said longitudinal edges for clamping a gutter length in said channel in sealing engagement with the sealing portion means such that the sealing portion means is compressed between the inside surface of the body member and the outside surface of the gutter length.

8. A gutter fitting as claimed in claim 7, wherein the end of the locating portion means remote from the sealing portion means is received within a passage defined between the retaining member and the body member and engages the retaining member.

9. A gutter fitting as claimed in claim 1, wherein the slot means comprises a row of openings which row extends transversely of the channel.

* * * * *